US007036260B2

(12) United States Patent
Gee

(10) Patent No.: US 7,036,260 B2
(45) Date of Patent: May 2, 2006

(54) METHOD AND SYSTEM TO PREVENT FIRING LIVE ROUNDS OF AMMUNITION DURING MILES EXERCISES

(76) Inventor: Robert Gee, 1720 Tierra del Oso, Albuquerque, NM (US) 87120

( * ) Notice: Subject to any disclaimer, the term of this patent is extended or adjusted under 35 U.S.C. 154(b) by 0 days.

(21) Appl. No.: 10/632,454

(22) Filed: Jul. 31, 2003

(65) Prior Publication Data

US 2005/0188830 A1 Sep. 1, 2005

Related U.S. Application Data

(60) Provisional application No. 60/400,229, filed on Aug. 1, 2002.

(51) Int. Cl.
*F41A 21/00* (2006.01)
*F41C 27/00* (2006.01)

(52) U.S. Cl. ..... 42/76.01; 42/77; 42/76.1; 89/14.05; 89/29; 102/444; 102/293

(58) Field of Classification Search ..... 42/76.01, 42/76.1, 70.01, 66, 77, 96; 89/14.05, 27.12, 89/28.2, 29, 193; 102/444, 293
See application file for complete search history.

(56) References Cited

U.S. PATENT DOCUMENTS

| | | | | |
|---|---|---|---|---|
| 2,075,837 | A * | 4/1937 | Studler | 89/14.5 |
| 2,880,543 | A * | 4/1959 | Von Frantzius | 42/1.08 |
| 2,887,013 | A * | 5/1959 | Marsh | 89/193 |
| 5,475,940 | A * | 12/1995 | Mauch et al. | 42/75.02 |
| 5,565,642 | A * | 10/1996 | Heitz | 89/7 |
| 5,937,563 | A * | 8/1999 | Schuetz et al. | 42/106 |
| 6,202,533 | B1 * | 3/2001 | Reynolds et al. | 89/29 |
| 6,481,144 | B1 * | 11/2002 | Chee et al. | 42/76.01 |
| 6,668,699 | B1 * | 12/2003 | Russell | 89/14.05 |

FOREIGN PATENT DOCUMENTS

CA 2189904 A * 5/1998

* cited by examiner

*Primary Examiner*—Michael J. Carone
*Assistant Examiner*—James S. Bergin
(74) *Attorney, Agent, or Firm*—Patzik, Frank & Samotny Ltd.

(57) ABSTRACT

A safety system for preventing a handheld firearm from discharging an inadvertently loaded live ammunition projectile or bullet during a training exercise or the like by safely venting through a series of substantially perpendicular vent holes in the barrel, the pressure needed to propel the bullet down and through the barrel towards the target—so as to retain the bullet in the bore and cause the firearm to shut down.

8 Claims, 3 Drawing Sheets

METHOD AND SYSTEM TO PREVENT FIRING LIVE ROUNDS OF AMMUNITION DURING MILES EXERCISES

This application claims priority based upon U.S. Provisional Patent Application Ser. No. 60/400,229 filed Aug. 1, 2002.

BACKGROUND OF THE INVENTION

The invention relates to a safety mechanism for preventing the accidental discharge of live ammunition during a training exercise and in particular, to a system for releasing the pressure generated from a live round of ammunition, thereby retaining the bullet in the bore of the firearm.

The invention comprises a pressure porting safety system for use in firearms used in the Multiple Integrated Laser Engagement System ("MILES"). MILES is a training system used by the Dept. of Defense, most branches of the military, both foreign and domestic, and law enforcement, as well as other federal agencies in what is called "Force on Force Exercises". In essence, this is a high tech version of laser tag, utilizing real firearms. The firearms use a laser transmitter, which activates when the weapon is fired and sends a laser signal to a harness worn by an adversary. If the shooter's aim is on, the harness responds with a "kill" signal, thereby indicating that the player has been removed from further participation in the training exercise. The MILES system is designed to use only blank ammunition. One such system is described in U.S. Pat. No. 4,948,371 to Hall.

One problem with the MILES system is that a person can inadvertently place a live round into the firearm and it will function as the gun was designed, meaning the bullet will actually exit the firearm when fired as in live warfare. Thus the unintentionally and unexpectedly fired ammunition will nevertheless possibly inflict unintended, yet serious bodily harm and/or property damage, because no live ammunition was expected by the shooter or the target. It is believed that this has happened many times through the years and has resulted in the deaths of several people. The present invention is based on the principle of releasing the pressure generated from the live round being fired, thereby retaining the bullet in the bore.

What has long been needed is a reliable method for preventing an inadvertently loaded live round of ammunition from being fired from a gun or rife, such as the M16 Rifle and the 9 mm Bereta Handgun or other standard-issue military, police or recreational guns—so as to prevent accidental shootings during training exercises, simulated combat situations or recreational use.

SUMMARY OF THE INVENTION

The present invention comprises a safety system and method of use for effectively preventing the undesired or unintended firing of live ammunition in the firearm or gun. A blank round differs significantly from a live round. First, the blank round uses a form of flash powder as its power source and generates about 10,000 psi of pressure in the cartridge case. This force gives the gun enough gas pressure to cycle the firearm's action, but not enough pressure to fire the blank round from the barrel.

A live round generates about 50,000 psi in pressure, which is enough energy to cycle the gun as well as send the bullet through the barrel and down range with enough velocity to hit the target. The present invention centers on this pressure. As when low pressure from a blank round serves to only cycle the gun but not fire the ammunition through and out of the barrel, the pressure from an inadvertently placed live round in a gun equipped with the present invention is used to retain the bullet in the barrel and shut the gun down—instead of unintentionally firing the bullet down range at possibly an unsuspecting human target.

The invention comprises a system for preventing the discharge of a live ammunition cartridge having a bullet portion, a shoulder portion and a case portion, from a firearm having a barrel portion with a longitudinal axis. It comprises a live ammunition cartridge loaded into the firearm the barrel portion of the firearm having one or more apertures formed therein, with each of the apertures being aligned so as to be substantially perpendicular to the shoulder portion of the live ammunition or the longitudinal axis of the barrel; aid, the live ammunition cartridge and the barrel being cooperatively associated, so as to vent the pressure, which is created by firing the ammunition, through the barrel apertures, so as to deprive the live ammunition cartridge of sufficient pressure, when fired, to propel the bullet along the longitudinal axis of the barrel, thereby retaining the bullet within the bore.

The invention further comprises a method for preventing the discharge of a live ammunition cartridge having a shoulder portion, from a gun having a barrel portion with a longitudinal axis, which comprises: drilling one or more apertures in the barrel in a direction substantially perpendicular to the longitudinal axis of the barrel or the shoulder portion of the live ammunition depending on the portion of the barrel which is proximate to where the cartridge is the weakest. The amount of venting needed depends on the caliber of the ammunition. The method further includes firing the firearm so as to vent the pressures created by the live ammunition cartridge through the apertures in the barrel portion and thereby depriving the cartridge of sufficient pressure to propel the bullet along the longtitudal axis of and out the barrel.

While six substantially perpendicular apertures are formed in the barrel proximate the spot where the shoulder of the cartridge is located in the shown and preferred embodiments, other numbers, locations, angles, shapes, arrangements and configurations of apertures should be deemed as being within the scope of the invention.

It is accordingly an object of the present invention to make a firearm loaded with live ammunition being used in a training exercise to shut down and prevent the firing of any inadvertently loaded live ammunition.

It is a further object of the present invention to provide a safety system that is easy to attach or detach and is interchangeable with the original components of guns so that the guns will not be permanently disabled by the safety system.

It is yet another object of the present invention to provide a safety system that is easy and economical to manufacture.

Another object of the present invention is to provide a safety system that is not prone to failure and is dependable, since unintended discharge of live ammunition during training exercises can result in loss of life.

Yet another object of the invention is to provide a safety system that does not significantly change the look, feel or weight of the gun on which it is used so as to simulate the use and transport of such weapons in actual warfare to the fullest extent possible.

This and other objects of the present invention will best be understood from the following drawings, description and claims.

DETAILED DESCRIPTION OF THE DRAWINGS

Figure 1:
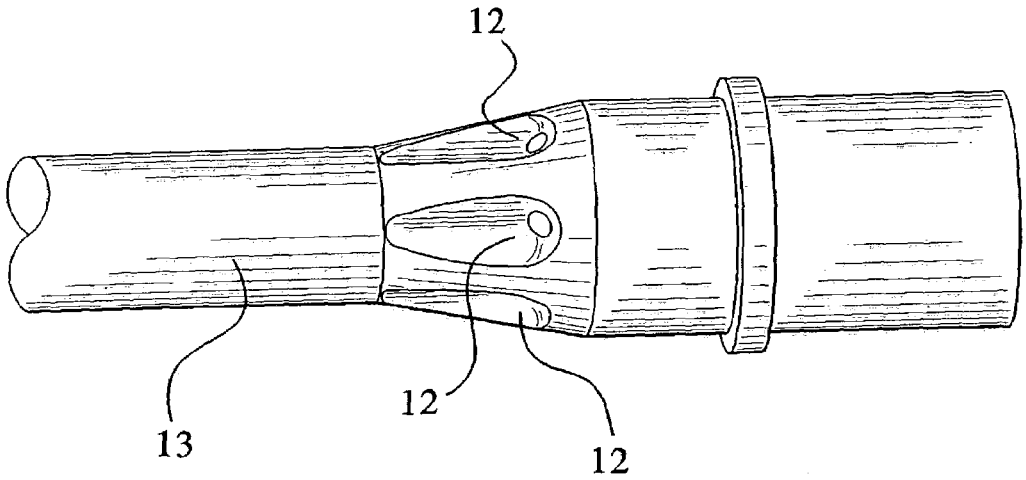
FIG. 1 is a side view of an M16 barrel with the vent holes of the invention drilled therein.

While this invention is susceptible to embodiment in many different forms, there is shown in the drawings and will herein be described in detail, one specific embodiment, with the understanding that the present invention is to be considered to be an exemplification of the principles of the invention and is not limited to the embodiment illustrated.

A rifle barrel is typically a long (14 to 30 inches) tapering tube made from steel or steel alloys with fairly thick walls. It starts as a steel bar and is drilled and reamed to a "bore diameter" corresponding to the ammunition cartridge it is intended to fire. The higher the pressure and velocity of a cartridge, the faster it will travel through the barrel and in turn the faster it will wear out the barrel. Hand guns typically use smaller caliber ammunition cartridges and accordingly have smaller diameter and shorter barrels.

An ammunition cartridge is generally comprised of two parts: the bullet which is the projectile which travels to and impacts the target; and, the brass case which, until fired, contains the gun powder and surrounds the back end of the bullet. Upon firing, the pressure created by compression and the corresponding exploding of the gun powder against the back of the barrel and casing propels the bullet through and out of the barrel. The spent case is usually ejected as well, but at a much lower speed and typically falls harmlessly to the ground a short distance away from the shooter.

Figure 3:
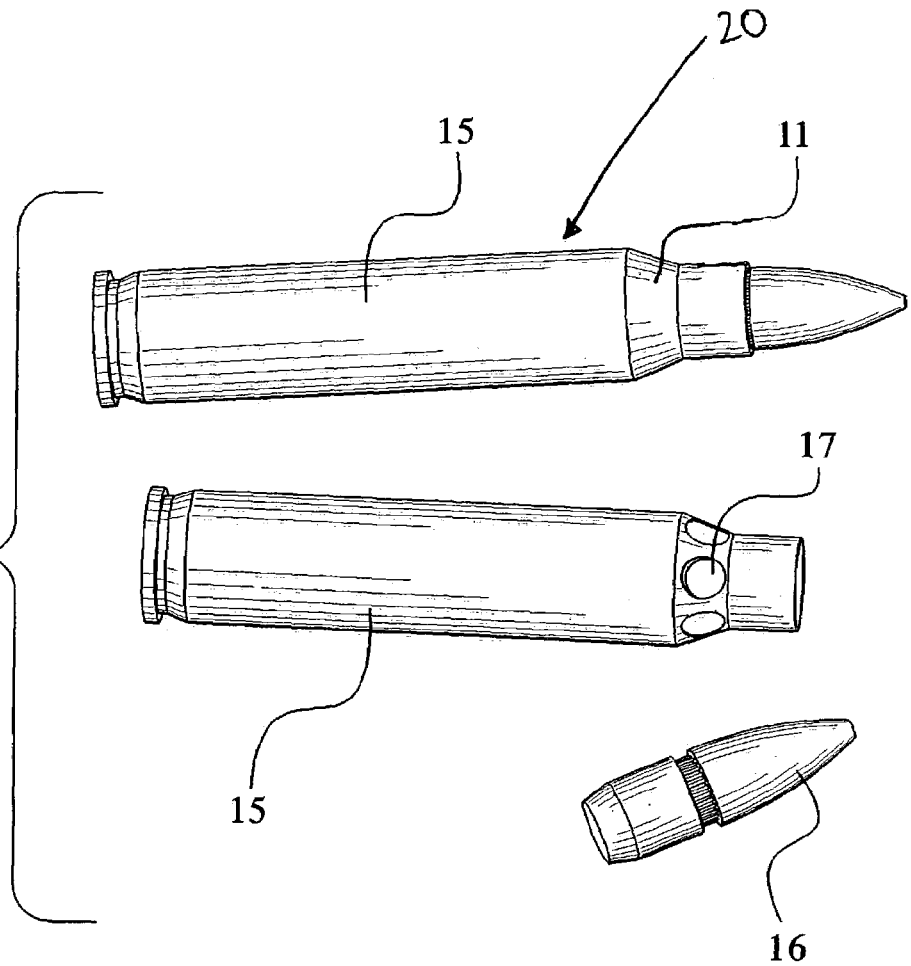
FIG. 3 is a side view of a live ammunition cartridge case before and after it has been fired in the system of the present invention.
Figure 2:
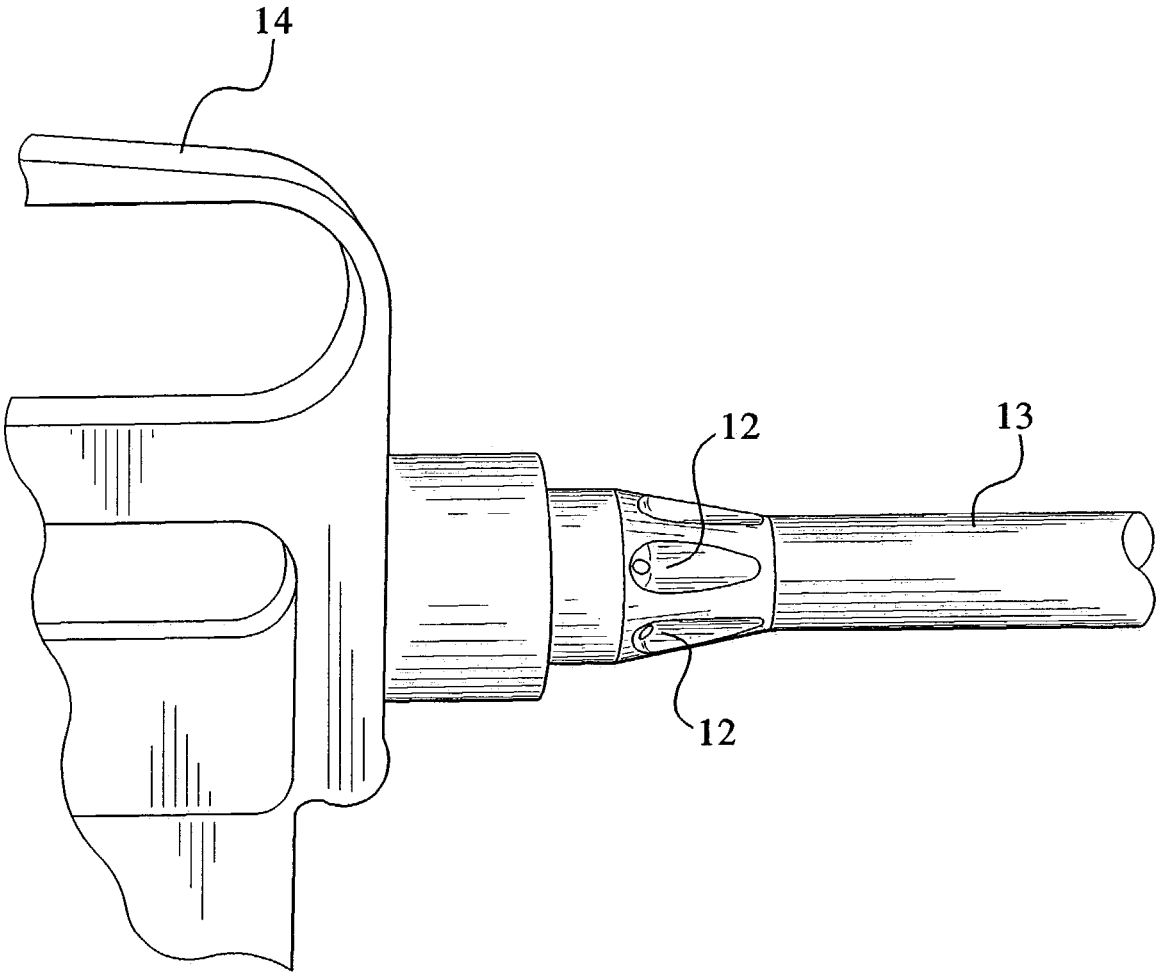
FIG. 2 is a side view of an M16 barrel with the vent holes of the present invention drilled therein.
Figure 4:
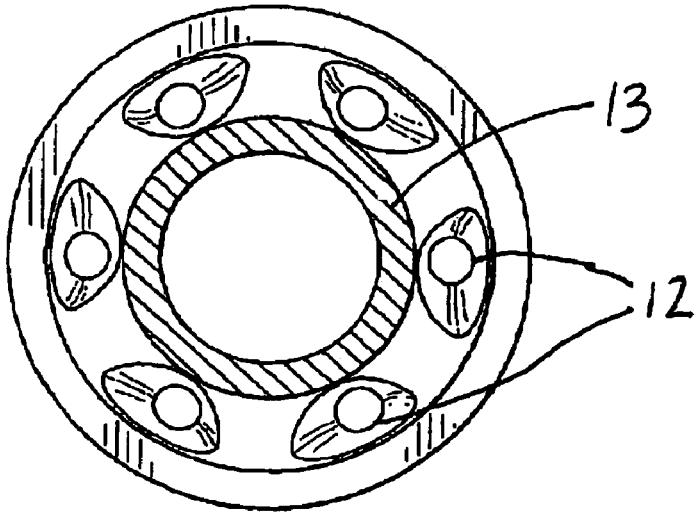
FIG. 4 is an elevated view of the barrel of the present invention showing six apertures.
Figure 5:
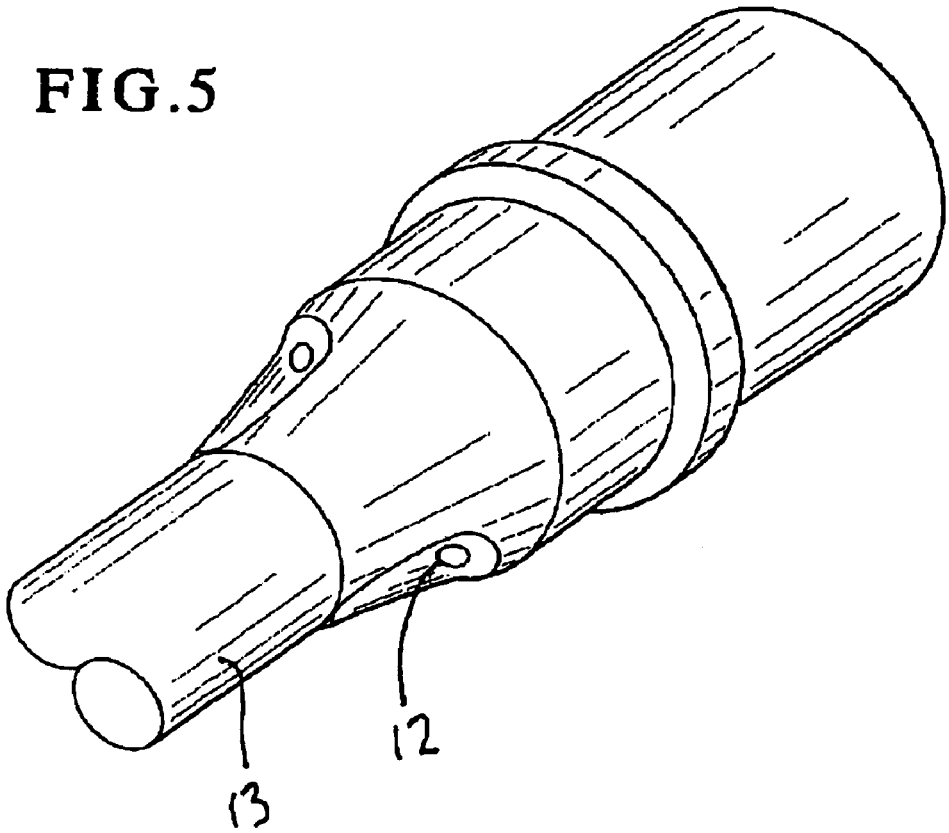
FIG. 5 is a perspective view of an alternate embodiment of the barrel of the present invention showing two apertures.

When a standard M16 cartridge case is cut in cross-section and measured, the thinnest portion of the brass and thereby the weakest point is in the shoulder area 11 of the case shown in FIG. 3. Accordingly, as shown in FIGS. 2 and 3, a series of six holes 12 are drilled through the barrel 13 of the rifle 14 at a point to intersect the shoulder 11 of the cartridge chamber at approximately a 90 degree angle to the shoulder. The six holes 17 formed in barrel 13 serve to provide a path of least resistance for pressure generated by a live round. As a result, when fired, the substantial pressure generated from the cartridge 20 of a live round serves to blow out the brass shoulder 11 of the live ammunition cartridge 20, which is the weak point of the assembled cartridge, proximate the six holes 12, thereby forming corresponding blow out holes 17 in casing 15 and venting the pressure out the substantially perpendicular corresponding holes 12 and not providing the live round sufficient pressure to allow the bullet 16 to be propelled with respect to the casing 15, or disengage from the casing 15 and move down the rifle bore 13.

In contrast, there is simply not enough pressure generated from a blank round to blow out these holes, so blank ammunition causes the gun to function as it is designed to operate when loaded with blank rounds. Live rounds, however, lose substantially all of their pressure out the blown holes 17 in the cartridge 15 and in turn the corresponding holes 12 drilled in the barrel 13 of the gun 14 thereby causing the gun to shut down without firing the bullet 16. In particular, the brass case 15 sticks in the chamber, not extracting or ejecting from the gun, the bullet 16 remains in the bore 13 and the firearm is totally locked up, thereby alerting the shooter to visually inspect the firearm for a malfunction. After firing the live round, the brass case 15 has six nearly perfect holes 17 blown out of the shoulder area 11, looking almost like someone drilled the six holes in the case itself.

While only M16 rifles are referred to herein, the modification of the present invention can be used on firearms including, but not limited to, as: Colt M-16 Rifles, FN 240 and 249 machine guns, Saco M-60 machine guns, and H&K rifles. The process is comparable for all these other types of firearms. One needs to locate the area on the barrel corresponding to the shoulder or other weakest spot of the cartridge in order to drill and figure out the amount of pressure that one needs to vent depending on caliber. The more powerful the cartridge, the more pressure needs to be vented. Hence, a more powerful cartridge will likely require more holes to be drilled in the barrel so as to be at substantially right angles to the weak point of the cartridge.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A system for preventing the discharge of a live ammunition cartridge having an angled shoulder and creating pressure when fired and including a bullet portion normally propelled by said pressure from a rifle or machine gun having a barrel with a longitudinal axis within which the ammunition cartridge is loaded and two sides, comprising:

the barrel of the rifle or machine gun having at least two apertures formed therein, with each of said at least two apertures being aligned with the shoulder of said live ammunition cartridge and said longitudinal axis of said barrel; and said live ammunition cartridge and said barrel being cooperatively associated, so as to vent said pressure created by firing said ammunition cartridge through said barrel apertures and thereby deprive said live ammunition cartridge of sufficient pressure to propel said bullet along said longitudinal axis of said barrel and retaining said bullet in said barrel.

2. The invention according to claim 1 wherein said at least two apertures are aligned substantially perpendicularly to said shoulder of said live ammunition cartridge.

3. The invention according to claim 1 wherein said shoulder of said live ammunition cartridge is the weakest portion of said live ammunition cartridge.

4. The invention according to claim 1 wherein said at least two apertures are located on said barrel such that the pressure is dispersed to at least one of the two sides of said rifle or machine gun.

5. The invention of claim 1 wherein said at least two apertures comprises six apertures spaced about said barrel.

6. A modified rifle barrel for preventing the discharge of a live ammunition cartridge having a shoulder and creating pressure when the rifle is fired and including a bullet normally propelled by said pressure down the rifle barrel, comprising:

six apertures spaced about the rifle barrel and aligned with the shoulder of said live ammunition cartridge; and said live ammunition cartridge and said barrel being cooperatively associated so as to vent said pressure created by firing said live ammunition cartridge through said six apertures and thereby deprive said live ammunition cartridge of sufficient pressure to propel said bullet through said barrel.

7. The invention according to claim 6 wherein said six apertures are aligned substantially perpendicularly to said shoulder of said live ammunition cartridge.

8. The invention according to claim 6 wherein said shoulder of said live ammunition cartridge is the weakest portion of said live ammunition cartridge.

* * * * *